United States Patent [19]

Neubüser et al.

[11] Patent Number: 4,474,093

[45] Date of Patent: Oct. 2, 1984

[54] APPARATUS FOR ACCUMULATING STACKS OF PAPER SHEETS OR THE LIKE

[75] Inventors: Siegmar Neubüser; Peter Dose; Friedhelm Herrig, all of Hamburg, Fed. Rep. of Germany

[73] Assignee: E.C.H. Will (GmbH & Co.), Hamburg, Fed. Rep. of Germany

[21] Appl. No.: 497,827

[22] Filed: May 25, 1983

Related U.S. Application Data

[62] Division of Ser. No. 287,190, Jul. 27, 1981, abandoned.

[30] Foreign Application Priority Data

Jul. 28, 1980 [DE] Fed. Rep. of Germany ..... 3028540

[51] Int. Cl.[3] ..... B65H 31/30; B65H 31/32

[52] U.S. Cl. ..... 83/71; 414/43; 414/115; 414/901; 83/74; 83/79; 83/88; 83/91

[58] Field of Search ..... 83/88, 90, 91, 650, 83/71, 74, 79; 377/6, 8; 414/43, 115, 901

[56] References Cited

U.S. PATENT DOCUMENTS

| | | | |
|---|---|---|---|
| 3,706,027 | 12/1972 | Grice, Jr. et al. | 377/6 X |
| 4,043,458 | 8/1977 | Schott, Jr. | 414/43 X |
| 4,184,392 | 1/1980 | Wood | 83/88 |
| 4,201,102 | 5/1980 | Rudszinat | 83/298 |
| 4,255,998 | 3/1981 | Rudszinat | 83/324 X |
| 4,267,752 | 5/1981 | Byrt et al. | 83/650 X |
| 4,297,066 | 10/1981 | Ramcke et al. | 414/43 |

FOREIGN PATENT DOCUMENTS

| | | | |
|---|---|---|---|
| 2508745 | 9/1976 | Fed. Rep. of Germany | 414/43 |

*Primary Examiner*—Robert J. Spar
*Assistant Examiner*—Ken Muncy
*Attorney, Agent, or Firm*—Peter K. Kontler

[57] ABSTRACT

Stacks of superimposed paper sheets are formed from a succession of layers each of which contains a given number of groups of sheets. One or more layers which contain a first number of groups can be followed by one or more layers containing a different second number of groups so that a stack can contain layers which, in turn, contain different numbers of groups and hence different numbers of sheets. The number of sheets in each stack and in each layer is a whole multiple of the number of sheets in a group. If the average number of sheets in a series of successive stacks is to deviate from a whole multiple of the number of sheets in a group, successive stacks contain different numbers of sheets; each such number is a whole multiple of the number of sheets in a group but the total number of sheets in the series of stacks divided by the number of stacks which form the series can deviate from such whole multiple.

18 Claims, 7 Drawing Figures

APPARATUS FOR ACCUMULATING STACKS OF PAPER SHEETS OR THE LIKE

CROSS-REFERENCE TO RELATED CASE

This is a division of our copending application Ser. No. 287,170 filed July 27, 1981 for "Method of accumulating stacks of paper sheets or the like" now abandoned.

BACKGROUND OF THE INVENTION

The present invention relates to an apparatus for accumulating or forming stacks of paper sheets or the like. More particularly, the invention relates to improvements in an apparatus for converting one or more reels or analogous sources of supply of flexible sheet, band or web material into stacks or piles containing preselected numbers of superimposed sheets, i.e., of sheets which overlap each other and can be used for the making of pads, books, pamphlets, brochures or the like. Such apparatus can be resorted to in connection with the mass production of the above-enumerated commodities, especially steno pads, exercise books, memo pads or like stationery products.

The trend in the paper processing industry and analogous industries is to accelerate the production of stationery products, books or the like. Certain presently known apparatus for the making of stacks of paper sheets or the like already employ several sources of supply of convoluted web, band or strip material and a cross cutter or an analogous severing device which simultaneously severs two or more webs so that the rate of making discrete sheets is multiplied, i.e., such rate equals the number of simultaneously severed webs multiplied by the frequency at which the severing apparatus cuts the webs so that each severing operation entails the making of a group of two or more overlapping or superimposed sheets. The groups are assembled into stacks wherein the total number of sheets is necessarily a whole multiple of the number of sheets in a group, i.e., if a group contains six sheets, the total number of sheets in a fully assembled stack must be a whole multiple of six. A drawback of such procedure is that the rate at which the cross cutter or an analogous device severs a plurality of webs to form a succession of groups cannot be increased at will because the removal of a fully assembled stack from the respective (stacking) station takes up a certain interval of time which, as a rule, is longer than the shortest interval between two consecutive severing operations if the cross cutter were permitted to operate at a reasonably high speed or at a maximum speed. In other words, it is not possible to increase the rate of making individual groups of sheets at the will of the attendants and/or at the will of the manufacturer because the removal of fully assembled stacks is the longest-lasting phase of the operation so that all other phases (which could be completed at a much faster rate) must be slowed down for the sole purpose of ensuring satisfactory removal of a fully assembled stack. Such removal not only involves physical transport of a fully assembled stack away from the stacking station but also the preparation of this station for reception of groups of sheets which are to form the next-following stack. Therefore, simultaneous conversion of two or more webs of paper or the like into discrete sheets and the gathering of such sheets into stacks cannot be performed at a speed which would be possible in view of the capacity of certain components (such as the cutoff) because the removal of stacks, especially of stacks which are assembled of groups containing relatively small numbers of sheets, is too time-consuming (as compared with the intervals of time required to carry out other operations, such as cross cutting) and necessitates a slowdown of the entire operation.

German Offenlegungsschrift No. 2,835,416 discloses an apparatus for transferring layers which consist of several sheets of paper or the like from a layer-forming or gathering station to a further processing station. The apparatus employs a tongs serving as a means for transferring layers from the gathering station to a removing conveyor which, in turn, transports the layers to the further processing station. Each layer is assembled of discrete sheets. The means for moving the tongs to and from its receiving position at the gathering station includes a drive which is independent of the main prime mover of the paper processing machine and includes a discrete prime mover as well as a mechanical transmission which is interposed between the discrete prime mover and the tongs. The mode of operation of the independent drive is such that the tongs must be accelerated from zero speed (position of dwell at the gathering station), that the tongs must be closed to engage a fully assembled layer of sheets at the gathering station, that the tongs extracts the engaged layer from the gathering station, that the tongs transfers the extracted layer to the removing conveyor (which delivers such layer to the further processing station), and that the tongs thereupon reassumes its idle position of dwell adjacent to the gathering station. The same sequence of steps is repeated when the next fully assembled layer is ready for transfer from the gathering station to the further processing station. Thus, the tongs is driven intermittently which is not conducive to rapid removal of layers from the gathering station. Moreover, the removing conveyor is not designed to deliver successive layers to a stacking station but rather directly to a further processing station, i.e., each layer can be said to constitute a small stack and the aforediscussed problems which arise when a stack is assembled of a series of groups of sheets (rather than from discrete sheets) remains unsolved. The only advantage of the procedure which is proposed in the German publication is that it renders it possible to assemble layers each of which contains a predetermined number of sheets, i.e., it is possible to count the individual sheets on their way to the gathering station and to remove a layer from such station when the counting operation indicates that the layer contains a desired (odd, even, large or small) number of superimposed sheets.

OBJECTS AND SUMMARY OF THE INVENTION

An object of the invention is to provide a novel and improved apparatus which is constructed and assembled in such a way that it can be rapidly converted from the assembly of stacks containing a first total number of sheets to the assembly of stacks having a different second total number of sheets or vice versa.

Another object of the invention is to provide the apparatus with novel and improved means for manipulating groups of stacks between a cross cutter or an analogous web severing device and the stacking station.

A further object of the invention is to provide the apparatus with novel and improved means for automatically selecting the sequence of gathering smaller accumulations of sheets into fully assembled stacks in accordance with or in dependency on a variety of parameters including the desired number of sheets in a stack, the desired format of sheets, the desired or permissible rate at which one or more webs are severed to yield discrete sheets and/or others.

An ancillary object of the invention is to provide a novel control system for use in an apparatus of the above outlined character.

A further object of the invention is to provide the apparatus with novel and improved means for accumulating groups of sheets or plural groups of sheets at a given station and for removing the accumulated sheets from such station.

Another object of the invention is to provide the apparatus within novel and improved means for varying the ratio of delivery of sheets to and the ratio of removal of gathered sheets from the just mentioned station.

An additional object of the invention is to provide the apparatus with novel and improved means for influencing the transfer of sheets to the stacking station in dependency on the rate at which one or more webs of paper or the like are converted into discrete sheets and/or as a function of the selected format of sheets.

One feature of the invention resides in the provision of an apparatus for forming stacks which consist of paper or an analogous flexible sheet, web or strip stock (such as synthetic plastic material, metallic foil or the like). The apparatus comprises means for forming a succession of groups of overlapping sheets each containing a predetermined number of sheets, means for accumulating at least one first layer from a first number of successively formed groups, means for thereupon accumulating at least one second layer from a different second number of successively formed groups, and means for accumulating the first and second layers into a stack.

The group forming means preferably comprises means for establishing several discrete sources of successive coherent sheets (e.g., two or more reels each of which contains a supply of convoluted paper web, such web constituting a succession of coherent sheets), means for drawing coherent sheets from such sources so that successive coherent sheets of one source register with successive coherent sheets of each other source, and means for repeatedly severing all coherent sheets to separate successive foremost registering sheets therefrom whereby the foremost sheets together form a group.

The apparatus preferably further comprises means for accumulating groups into layers at a first station and for accumulating layers into stacks at a discrete second station. Such apparatus then further comprises means for transferring successively formed layers from the first to the second station at different intervals whose duration is a function of (i.e., proportional or related to) the number of groups of sheets in the respective layers.

Expressed in a different way, each stack which is formed in the improved apparatus may contain a total of n sheets wherein n equals $z_1$ times r times p plus $z_2$ times r times q. In this equation, r is the number of sheets in a group, $z_1$ is the number of groups in a first layer, $z_2$ is the number of groups in a second layer, p is the number of first layers, and q is the number of second layers.

The apparatus preferably further comprises means for automatically shifting from accumulation of first layers to accumulation of second layers upon completion of the assembly of a preselected number (p ) of first layers.

If the number of sheets in a stack cannot exactly match the desired or optimum number of sheets (i.e., if the desired or required total number (n) of sheets in a stack is not a whole multiple of the number (r) of sheets in a single group) but it suffices if the average number (N) of sheets in a relatively long or relatively short series of successively formed stacks matches the desired or required number n, the apparatus further comprises means for accumulating at least one additional stack wherein the number of sheets is different from the number of sheets in the previously formed stack but the combined number of sheets in such previously formed and additional stacks is y times N wherein y is the combined number of stacks (N is not or need not be a whole multiple of r, i.e., of the predetermined number of sheets in a group). The number y can equal $x_1+x_2$ wherein $x_1$ is the number of stacks having N−a sheets and $x_2$ is the number of stacks having N+b sheets (N−a and N+b are divisible, without rest, by r, i.e., each of the numbers N−a and N+b is a whole multiple of r). Furthermore $x_1$ times a equals $x_2$ times b.

The apparatus can further comprise means for storing the information pertaining to the number of first and second layers and for utilizing the stored information for the assembly of requisite numbers of first and second layers. Such information can be stored in the memory of a suitable computer.

The speed of removal of layers from the aforementioned first station can be selected in dependency on at least one additional parameter, especially the maximum permissible operating speed of at least one aggregate in the apparatus, e.g., in dependency on the maximum possible or permissible rate of severing two or more overlapping webs of paper or the like by a cross cutter or the like and/or in dependency on the desired format of sheets which are gathered first into groups, then into layers and finally into stacks.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
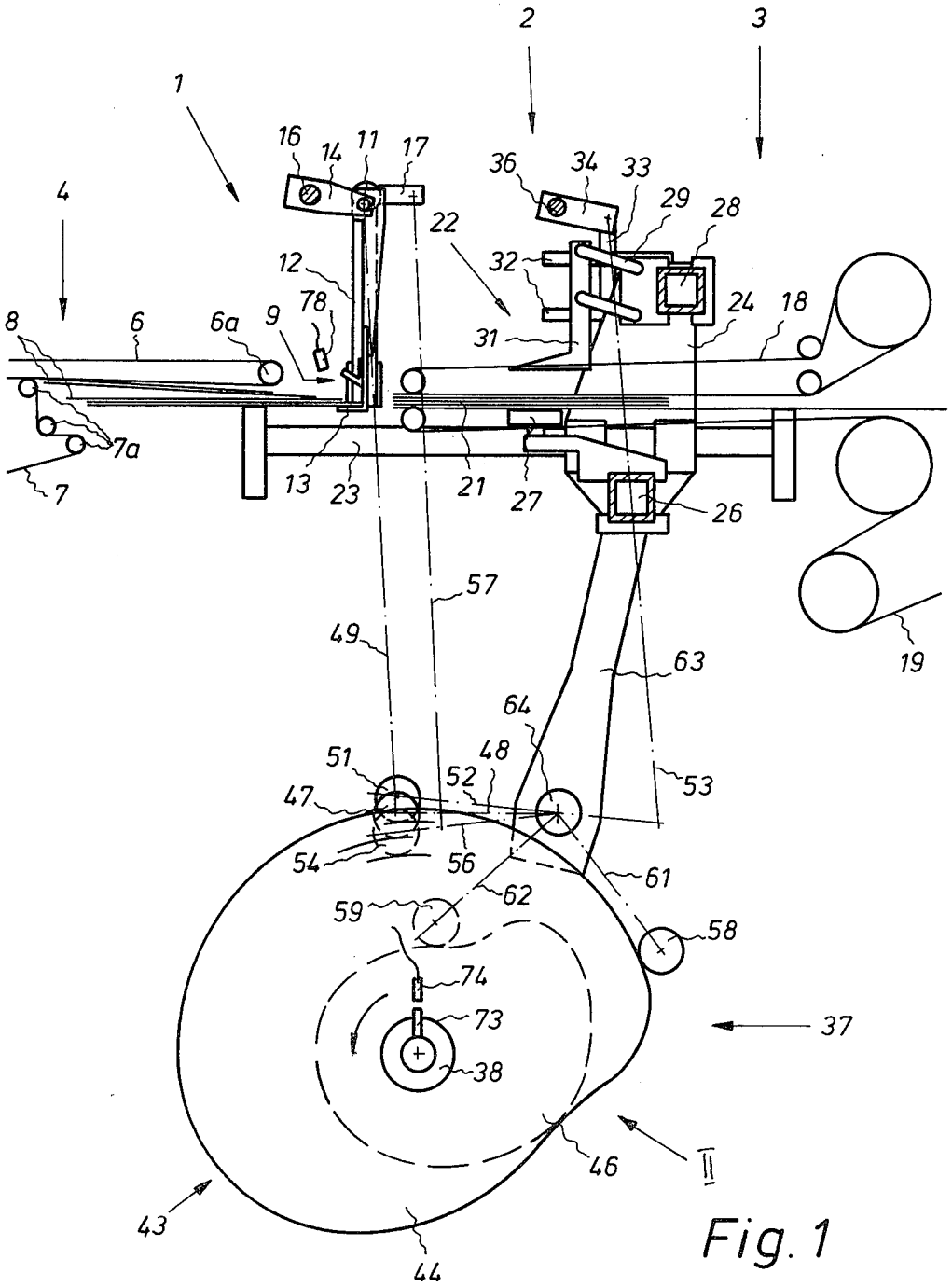
FIG. 1 is a schematic partly elevational and partly sectional view of an apparatus which embodies one form of the invention and wherein the gathering station is in the process of accumulating a fresh layer of groups of sheets while the previously assembled layer is in the process of being delivered to the stacking station.
Figure 2:
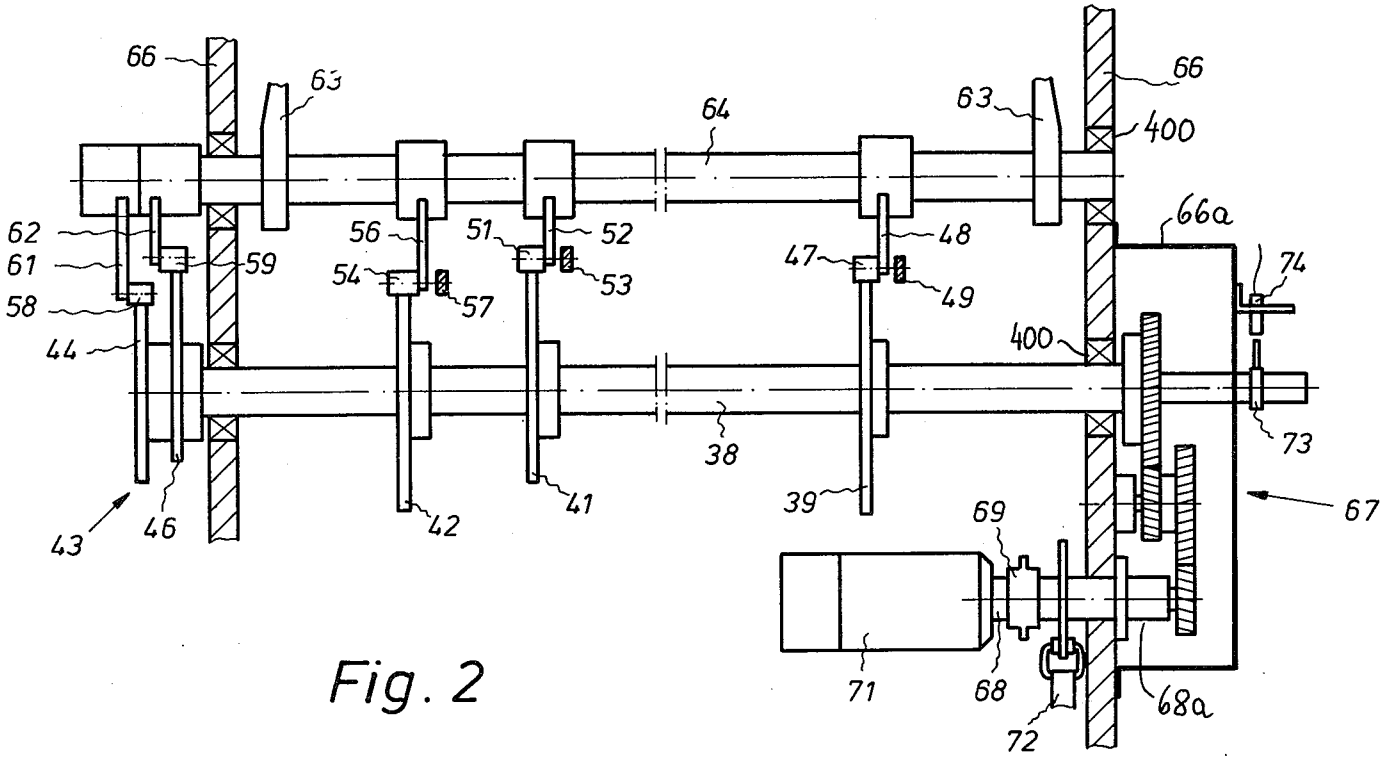
FIG. 2 is a partly horizontal sectional view and a partial bottom plan view of the apparatus as seen in the direction of arrow II in FIG. 1.
Figure 4:
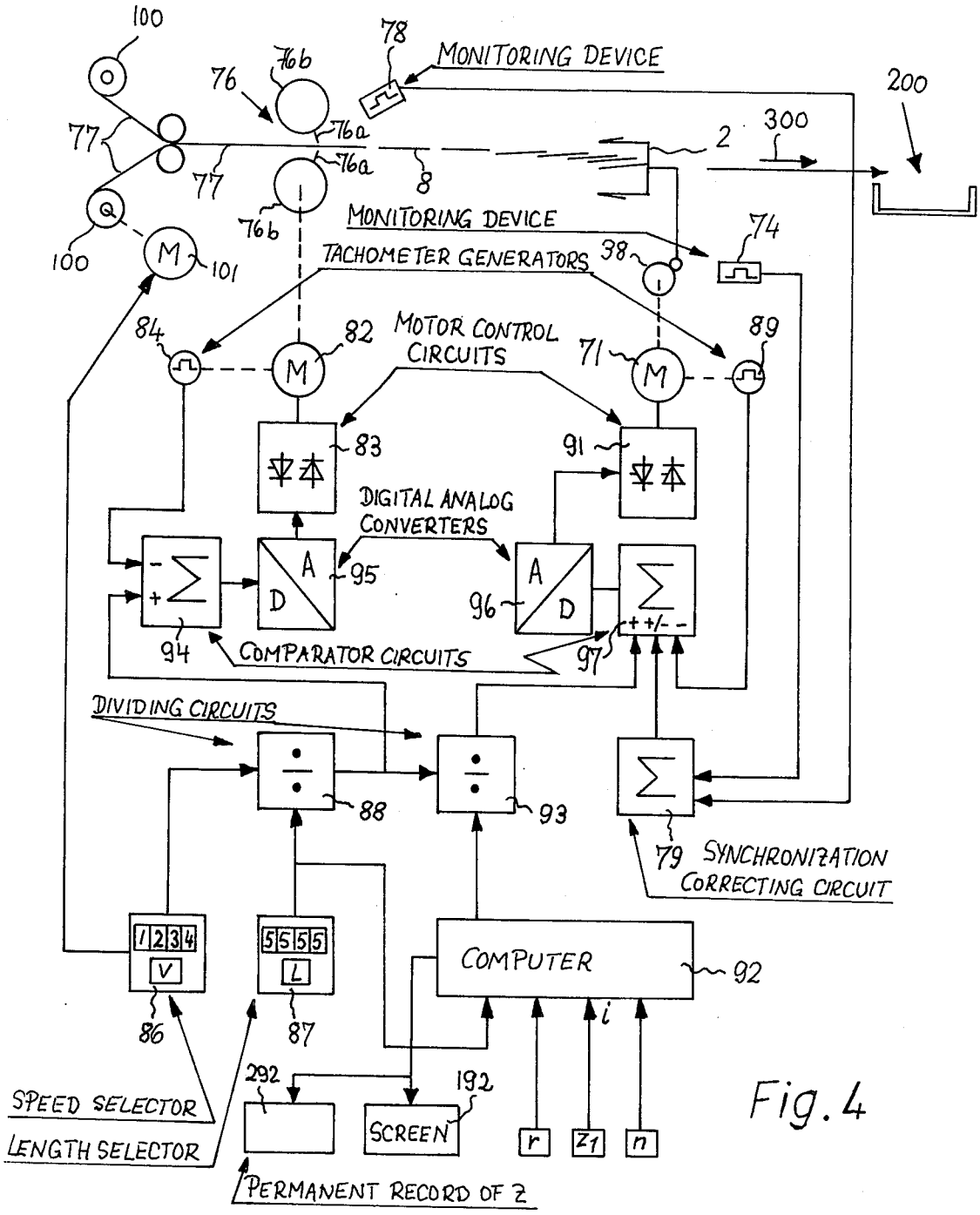
FIG. 4 is a circuit diagram of the system which can change the angular velocity of the timing shaft to thereby change the ratio of the number of machine cycles per working cycle of the apparatus.

Referring first to FIGS. 1, 2 and 4, they show a portion of a paper processing machine which includes means for converting several webs (coherent sheets) 77 (see the upper-left hand portion of FIG. 4) of paper into groups 8 of superimposed (overlapping) sheets and which thereupon converts such groups into stacks which are accumulated at a stacking (second) station 200 shown in the right-hand portion of FIG. 4. The webs 77 are drawn off discrete sources in the form of reels or bobbins 100 of which two are shown in the upper left-hand portion of FIG. 4. The severing means for subdividing the webs 77 into groups 8 of superimposed sheets each of which contains a predetermined number (r) of sheets includes a cross cutter 76 also shown in the upper left-hand portion of FIG. 4. The number (r) of sheets in a group 8 matches the number of reels 100. As can be seen in the upper left-hand portion of FIG. 4, the webs 77 which advance from the respective reels 100 toward the severing or subdividing station accommodating the cross cutter 76 overlie or overlap each other (as viewed from the top of FIG. 4) so that the orbiting knives 76*a* on the two rotary knife holders 76*b* of the cross cutter 76 can simultaneously sever r webs 77, i.e., each cutting or severing operation results in the formation of a group 8 consisting of r overlapping or superimposed sheets. The rate at which the groups 8 are produced is a function of the frequency at which the cross cutter 76 severs the coherent sheets or webs 77.

In accordance with a feature of the invention, the apparatus which includes the component parts disposed between the severing means or cross cutter 76 and the stacking station 200 includes a (first) station 1 which can be referred to as a preliminary gathering or preassembling station for selected (variable) numbers of groups 8. The means for supplying successive groups 8 of overlapping sheets from the severing means (cross cutter 76) to the station 1 (hereinafter called gathering station) comprises a first conveyor or supply conveyor 4, and the means for transporting selected numbers of gathered groups 8 (hereinafter called layers 21 ) from the gathering station 1 to the stacking station 200 comprises a transfer unit 2 and a second or removing conveyor 3. The purpose of the transfer unit 2 is to deliver successively gathered layers 21 from the station 1 into the range of the conveyor 3 which advances such layers to the stacking station 200. The transfer unit 2 comprises a gripper or tongs 22 which is movable back and forth, as considered in the direction of transport of layers 21 from the gathering station 1 to the stacking station 200. Such direction is indicated by the arrow 300 (see the upper portion of FIG. 4).

The supply conveyor 4 comprises a plurality of pairs of discrete endless belt or band conveyors each of which includes an upper endless belt 6 and a lower endless belt 7. The belts 6 are trained over pulleys 6*a* of which only one can be seen in the upper left-hand portion of FIG. 1, and the belts 7 are trained over pulleys 7*a* three of which are shown in the upper left-hand portion of FIG. 1. Each upper belt 6 is disposed in a vertical plane which is common to the plane of the respective lower belt 7. The groups 8 which are formed at the severing or subdividing station are engaged by the lower reaches of the upper belts 6 and by the upper reaches of the lower belts 7 and are thereby advanced along a substantially horizontal path and on to the gathering station 1.

In the embodiment which is shown in the drawing, each holder 76*b* carries a single knife 76*a*. Therefore, each revolution of a holder 76*b* results in the formation of a single group 8 of r superimposed paper sheets. However, it is equally within the purview of the invention to equip each of the holders 76*b* with several knives 76*a* so that each revolution of a holder results in the formation of two or more groups of paper sheets. Cross cutters which can be utilized in the apparatus of the present invention is disclosed in U.S. Pat. Nos. 4,201,102 and 4,255,998 respectively granted May 6, 1980 and Mar. 17, 1981 to Willy Rudszinat. For the sake of convenience, the disclosures of these United States Letters Patent are incorporated herein by reference.

The apparatus further comprises an adjustable gathering device or stop 9 which is installed at the gathering station 1 and preferably consists of a series of aligned levers 12 secured to a horizontal shaft 11. The shaft 11 carries the upper end portions of the levers 12, and the lower end portion of each lever 12 has a bent-over portion or pallet 13 which is normally located at a level below the path of an oncoming group 8 and faces in a direction toward the discharge end of the supply conveyor 4, i.e., toward the severing or subdividing station accommodating the cross cutter 76.

The end portions of the shaft 11 are mounted on the right-hand end portions of two levers 14 of which only one can be seen in FIG. 1. The levers 14 are pivotable about the axis of a horizontal shaft 16 which is parallel to the shaft 11. Each lever 12 comprises a substantially horizontal projection 17 which is located at a level close to or matching that of the shaft 11. Therefore, each of the levers 12 can be said to constitute a two-armed lever the lower arm of which carries the respective pallet 13 and the upper arm of which is constituted by the respective projection 17.

The end portions of the shaft 16 are journalled in two frame members 66 shown in FIG. 2. The arrangement is such that the gathering device or stop 9 moves up or down in response to pivoting of the levers 14 (which carry the shaft 11) about the axis of the shaft 16, and that the stop 9 (i.e., each of its levers 12) pivots to move the pallets 13 forwardly or backwards (i.e., in and counter to the direction indicated by the arrow 300 of FIG. 4) in response to pivoting of the levers 12 about the axis of the shaft 11. This renders it possible to advance a fully assembled layer 21 from the station 1 into the range of the removing conveyor 3 when the stop 9 is lifted and is thus moved out of the way, or to return the stop 9 to the position of FIG. 1 in which its pallets 13 support the leader of the lowermost group 8 at the station 1 and the groups 8 above such lowermost group are caused to neatly overlie each other by striking against the lower arms of the levers 12 above the pallets 13.

The removing conveyor 3 is analogous to the supply conveyor 4. Thus, the removing conveyor 3 also comprises several pairs of superimposed endless belt or band conveyors including an upper endless belt 18 and a lower endless belt 19 which is coplanar with the respective upper belt 18. A layer 21 which contains a predetermined number of superimposed groups 8 can be engaged by the lower reaches of the upper belts 18 and by the upper reaches of the lower belts 19 for transfer to the stacking station 200. The exact construction of the mechanism or mechanisms at the stacking station 200 forms no part of the present invention. Reference may be had, for example, to commonly owned U.S. Pat. No. 4,249,844 granted Feb. 10, 1981 to Siegfried Lampe et al. For the sake of convenience, the disclosure of this United States Letters Patent is incorporated herein by reference. It will be understood, however, that any other suitable stacking device which can accumulate two or more layers 21 into a taller layer or stack can be used with equal advantage.

The tongs 22 of the transfer unit 2 is mounted on a carriage or support 24 which is reciprocable along guide rails 23 in and counter to the direction indicated by the arrow 300, i.e., toward and away from the gathering station 1 as well as away and toward the stacking station 200. More specifically, the tongs 22 is reciprocable along a relatively short path so that it can engage a layer 21 which is assembled at the gathering station 1 and can advance such layer well into the range of the removing conveyor 3. The rails 23 flank the path for the layers 21. The carriage 24 for the tongs 22 includes or supports a lower crosshead 26 which is located at a level below the adjacent end portions of the lower belts 19 and extends transversely of the direction indicated by the arrow 300. The crosshead 27 serves to support the lower portion or jaw 26 of the tongs 22. A second horizontal crosshead 28 of or on the carriage 24 is located at a level above the adjacent end portions of the belts 18 and indirectly supports the articulately mounted upper portion or jaw 31 of the tongs 22. The connection between the upper crosshead 28 and the jaw 31 comprises a set of parallel links 29 having first end portions articulately connected with the crosshead 28 (or with a part which is supported by the crosshead 28) and second end portions articulately connected with the upper portion of the upper jaw 31. The means for moving the upper jaw 31 toward and away from the lower jaw 27 of the tongs 22 comprises a substantially vertically reciprocable bolt 33 which is indirectly coupled with the jaw 31 by rails 32 and is articulately connected to one end portion of a lever 34. The other end portion of the lever 34 is pivotable about the axis of a horizontal shaft 36.

The means 37 for imparting motion to and for adjusting the stop 9, the upper jaw 31 of the tongs 22 and the carriage 24 comprises a transmission which is shown in FIGS. 1 and 2 and comprises a horizontal camshaft or timing shaft 38 for a set of disc-shaped cams 39, 41, 42 and 43 (see particularly FIG. 2). The cam 43 (hereinafter called positive-action cam) serves to positively drive the part or parts which receive motion therefrom and is a composite cam assembled of two disc cams 44 and 46 which are rigidly connected to each other.

The cam 39 is tracked by a roller follower 47 and serves to effect upward and downward movements of the stop 9 by way of a linkage including the links 48 and 49. The link 49 is attached to the shaft 11 and the link 48 is mounted on a shaft 64 and is articulately connected with the link 49. The roller follower 47 is mounted at the junction of the links 48 and 49.

The cam 41 is tracked by a roller follower 51 and serves to open and close the tongs 22. The connection between the roller follower 51 and the means for moving the upper jaw 31 of the tongs 22 toward or away from the lower jaw 27 comprises a pair of articulately connected links 52 and 53.

The periphery of the cam 42 is tracked by a third roller follower 54 and this cam serves to effect forward and rearward movements of the pallets 13 at the lower ends of levers 12 constituting the stop 9. The operative connection between the projections 17 of the levers 12 and the cam 42 further comprises a pair of links 56 and 57.

The positive-action cam 43 is tracked by two roller followers 58 and 59 which respectively engage the peripheries of the disc cams 44 and 46 (see FIG. 2) and cooperate with links 61 and 62 as well as with two levers 63 in order to shift the carriage 24 back and forth, namely, in and counter to the direction indicated by the arrow 300. The links 48, 52, 56, 61 and 62 are mounted on the aforementioned shaft 64 which is rotatably journalled in the frame members 66 of the apparatus. The shaft 64 is parallel to the camshaft 38 and each of these shafts is rotatable in antifriction bearings 400 shown in FIG. 2.

The means for continuously rotating the camshaft 38 is illustrated in the lower right-hand portion of FIG. 2. Such rotating means comprises a prime mover here shown as a variable-speed electric motor 71 the output element 68 of which drives an overrunning clutch 69. The clutch 69 transmits torque to the camshaft 38 through the medium of a gear transmission 67. The reference character 72 schematically denotes a braking device for a shaft **68*a* which is driven by the clutch 69 and transmits rotary motion to the first gear of the transmission 67**.

The cams 41 and 43 can be said to constitute a means for connecting the motor 71 with the transfer unit 2.

The apparatus which is shown in FIG. 2 further comprises signal generating detector means for monitoring the angular position and the RPM of the camshaft 38. Such monitoring means or detector means comprises a proximity detector 74 which is mounted on a housing member **66*a* affixed to the right-hand frame member 66 and cooperates with a permanent magnet or another suitable actuator 73 which is secured to and orbits about the axis of the camshaft 38**.

FIG. 4 is a schematic block diagram of the circuit which also forms part of the means for adjusting the stop 9 and the transfer unit 2 and actually regulates or controls the operation of the improved apparatus. The upper portion of FIG. 4 further illustrates the aforementioned reels 100, the cross cutter 76, several groups 8 of superimposed paper sheets, the transfer unit 2, and the stacking station 200. The variable-speed electric motor 71 drives the camshaft 38 which is operatively connected when the gathering device or stop 9 and carriage 24 as well as with the tongs 22 in a manner as already explaned in connection with FIGS. 1 and 2.

The means for rotating the holders **76*b* of the cross cutter 76 comprises a second prime mover here shown as a variable-speed electric motor 82 which is regulated (independently of the motor 71) by a preferably thyristorized control circuit 83. The RPM of the motor 82 is monitored by a tachometer generator 84 which transmits corresponding signals to a first input of a comparator circuit 94. The reference character 86 denotes an adjustable control circuit serving to select the speed of the main prime mover 101 (e.g., a variable-speed electric motor) which drives the reels 100. Thus, the control circuit 86 determines the speed of lengthwise movement of the coherent sheets or webs 77** toward the severing or subdividing station for the cross cutter 76. Such adjustment can be effected independently of any adjustments of the motor 71. A further control circuit which selects the length (format) of sheets constituting the groups 8 is shown at 87. The length of the sheets can be changed by changing the ratio of speeds of the prime movers 82 and 101. The control circuits 86 and 87 transmit signals respectively denoting the speed of lengthwise movement of the webs 77 (namely the machine speed) and the desired length of sheets which form the groups 8 to the corresponding inputs of a dividing circuit 88 whose output is connected with a second input of the comparator circuit 94. The output of the comparator circuit 94 is connected with the input of a digital analog converter 95, whose output is connected with the input of the thyristorized control circuit 83. The signal at the output of the dividing circuit 88 corresponds to the quotient of signals denoting the momentary machine speed (see the circuit 86) and the selected length (format) of sheets forming the groups 8 (see the circuit 87). The signal at the output of the dividing circuit 88 controls or influences the speed of the motor 82 for the knife holders 76*b* of the cross cutter 76. The signals which are transmitted by the tachometer generator 84 denote the momentary speed of the output element of the motor 82 and are transmitted to the first input of the comparator circuit 94 for comparison with the reference signal at the output of the dividing circuit 88. The output signal of the comparator circuit 94 automatically adjusts the speed of the motor 82 when the signal which furnished by the tachometer generator 84 deviates from the signal at the output of the dividing circuit 88. The motor 71 for the camshaft 38 receives signals from a control circuit 91 which is preferably a thyristorized circuit similar to that shown at 83. The input of the control circuit 91 is connected with the output of a digital analog converter 96 whose input is connected with a comparator circuit 97. A tachometer generator 89 which monitors the speed of the output shaft 68 of the motor 71 transmits signals to a first input of the comparator circuit 97. A synchronization circuit 79, further preferably a comparator circuit, comprises a first input which is connected with the output of the aforementioned proximity detector 74 (i.e., of the device which monitors the angular position of the camshaft 38) and a second input which is connected with a detector 78 (preferably corresponding to the detector 74) which monitors the angular position (and hence the RPM) of one of the knife holders 76*b* in the cross cutter 76. The output of the correcting circuit 79 is connected with another or second input of the comparator circuit 97 for the variable-speed motor 71.

A third input of the comparator circuit 97 for the motor 71 is further (indirectly) connected with the output of a selector circuit 92 which can be influenced by the following parameters: the number (r) of webs 77 which are simultaneously severed by the knives 76*a* of the cross cutter 76; the number $z_1$ of the groups 8 which are accumulated at the station 1 into successive layers 21 before the speed of the motor 71 and camshaft 38 is reduced from a first speed $v_1$ to a second speed $v_2$; and the number (n) of sheets in the stacks which are to be accumulated at the station 200. The exact manner in which signals denoting such parameters can be transmitted to the circuit 92 is not shown in FIG. 4. It suffices to say that the circuit 92 can be connected with a suitable keyboard or a like instrument which enables an attendant to select the values of desired parameters r, n and $z_1$.

The output of the selector circuit 92 is connected with the input of the comparator circuit 97 by a dividing circuit 93 serving to transmit signals corresponding to quotients of reference signals for the speed of the motor 82 and the output signals of the circuit 92. Such quotient is the reference signal for the speed of the motor 71 which drives the camshaft 38. The dividing circuit 93 is connected not only with the output of the selector circuit 92 but also with the output of the aforementioned dividing circuit 88. A fourth input of the selector circuit 92 is connected with the output of the control circuit 87. Signals denoting the speed of the motor 82 (see the tachometer generator 84) denote the so-called machine cycles, namely, the rate at which the cross cutter 76 severs the webs 77 to form successive groups 8 of r sheets each. The signals which are transmitted by the tachometer generator 89 denote the so-called working cycles of the machine, namely, the angular positions of the camshaft 38 and hence the frequency of transfer of layers 21 from the gathering station 1. The duration of each working cycle can be a multiple of the duration of a machine cycle, i.e., and as already explained hereinabove, each layer 21 (which is assembled within a working cycle) can contain or consist of two or more groups 8 (each group 8 is formed during a machine cycle). Thus, if the number of groups 8 in a layer 21 is six, the duration of a working cycle is 6 times the duration of a machine cycle. Otherwise stated, the interval which is required for completion of one revolution of each of the knife holders 76*b* may be a small fraction of the interval which is required to complete one revolution of the camshaft 38.

The selector circuit (computer) 92 has a further output which is arranged to transmit signals (e.g., denoting the value of $z_1$ or $z_2$) to a means for recording the number of groups 8 in successively accumulated layers 21. The recording means may include a screen 192 or a like device for visually indicating the numbers of groups 8 in successive layers 21 and/or a means 292 (e.g., a tape recorder or a recording stylus) for producing a permanent record of the numbers of groups 8 in successive layers 21. The parts 192 and 292 can also serve for temporary or permanent recording of other data, such as the total number of sheets in successive stacks, the momentary speed of the camshaft 38 and/or other information.

Figure 3:
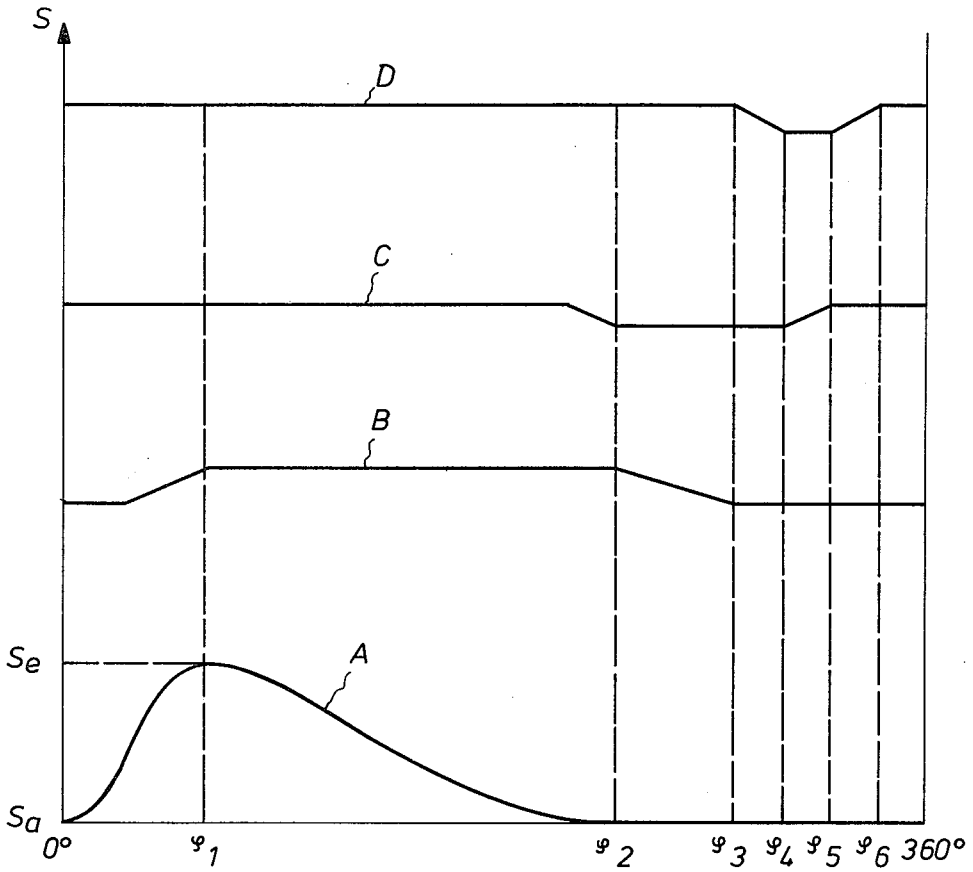
FIG. 3 is a diagram showing the positions of various mobile components of the apparatus in different angular positions of a continuously driven timing shaft.

FIG. 3 is a diagram wherein the positions of the stop 9, tongs 22 and carriage 24 are indicated along the ordinate and the angular positions (in angles $\phi$) of the camshaft 38 are indicated along the abscissa. The diagram of FIG. 3 will be referred to extensively in connection with explanation of the mechanical mode of operation of the transfer unit 2 shown in FIGS. 1, 2, 5, 6 and 7.

The lowermost curve A of FIG. 3 denotes the positions of the carriage 24 for the tongs 22 in different angular positions of the camshaft 38. The next-to-the-lowermost curve B of FIG. 3 illustrates various positions of the movable jaw 31 of the tongs 22 in different angular positions of the camshaft 38; the curve C denotes different positions (lifting and lowering) of the stop 9, as considered in a direction transversely of the path of movement of the groups 8 and layers 21; and the curve D denotes the positions of the pallets 13, as considered in and counter to the direction indicated by the arrow 300 of FIG. 4, again in different angular positions of the camshaft 38.

In accordance with a feature of the invention, the camshaft 38 is driven continuously, i.e., the motor 71 is on whenever the apparatus is in actual use. As mentioned above, the interval of time which is required for completion of one full revolution of the camshaft 38 corresponds to a working cycle of the transfer unit 2. In order to properly synchronize the working cycles with the machine cycles (namely, with the rate at which the cross cutter 76 forms successive groups 8), the detector 74 monitors the angular position of the camshaft 38 and the detector 78 monitors the angular positions of the holders **76*b*, i.e., the detector 78 transmits a signal in response to each severing of several superimposed webs 77 (which is tantamount to the making of groups 8). As shown in FIG. 4, such signals are transmitted to the corresponding inputs of the synchronization correcting circuit 79 which converts the incoming signals into outgoing synchronizing signals that are utilized to regulate the speed of the motor 71 for the camshaft 38 (through the medium of the control circuit 91). FIG. 4 further shows that the signal at the output of the correcting circuit 79 is but one of the signals which influence the control circuit 91 and hence the speed of the motor 71 for the camshaft 38. Another signal which influences the control circuit 91 is that which appears at the output of the dividing circuit 93. The signal at the output of the dividing circuit 93 is a function of the speed of the motor 82 which drives the holders 76*b* for the knives 76*a* of the cross cutter 76. More specifically, the signal which is transmitted to the left-hand input of the dividing circuit 93 is a quotient of the signal transmitted by the circuit 86 and denoting the speed of lengthwise movement of the webs 77 as well as of the signal denoting the selected length of sheets forming the groups 8 (see the circuit 87). The dividing circuit 93 transmits a signal which indicates the number (z) of the groups 8 which are to be gathered into a layer 21 prior to transfer of such layer from the station 1. The aforedescribed circuit arrangement ensures that the cross cutter 76 operates in synchronism with the transfer unit 2**.

The cams 39, 41, 42 and 43 are fixed to and share all angular movements of the camshaft 38 to actuate the component parts of the transfer unit 2 as well as the stop 9 in a sequence which is determined by relative angular positions (as well as by the configuration) of such cams on the shaft 38.

Figure 7:
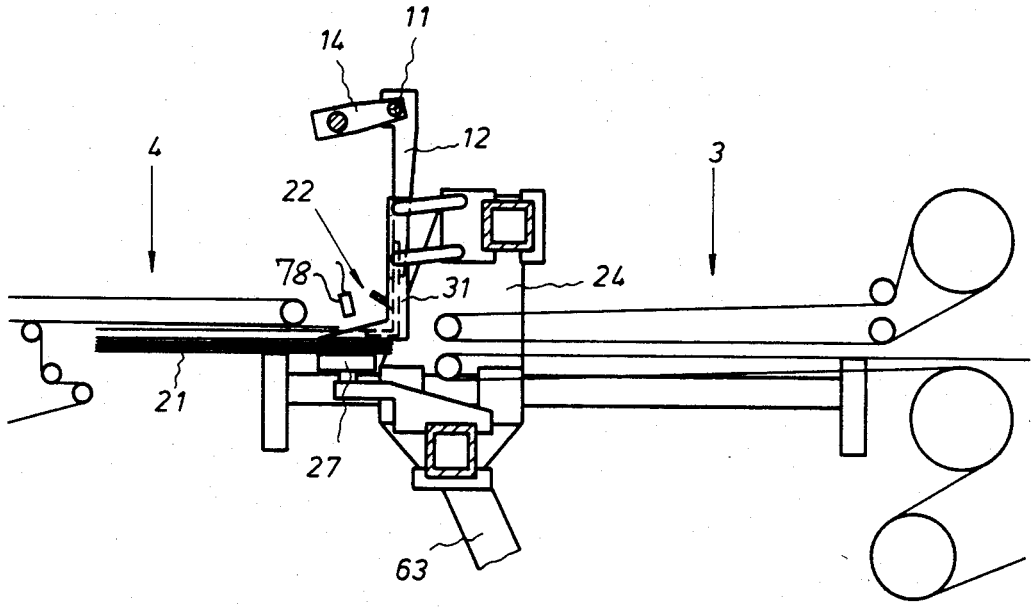
FIG. 7 shows the structure of FIG. 5 or 6 but with the moving parts in third position.

FIG. 7 illustrates the starting position of the transfer unit 2. This unit assumes such position in the angular position $\phi_6$ (see FIG. 3) of the camshaft 38. The starting position of the transfer unit 2 thereupon remains unchanged until the camshaft 38 reaches the 360° or 0° position, i.e., until after completion of the working cycle which was then in progress. The carriage 24 for the tongs 22 is held in its front or foremost position $S_a$, the tongs 22 is closed and grips a layer 21, and the stop 9 is held in the raised position and is pivoted to its front or foremost position.

As stated before, the camshaft 38 is rotated at a constant rate so that it moves beyond the angular position of 0° and to the position $\phi_1$ whereby the carriage 24 is caused to move to its rear end position $S_e$ while the camshaft 38 moves from the 0°-position to the position $\phi_1$ shown in FIG. 3. This causes the tongs 22 to move the layer 21 to the removing conveyor 3. The angular velocity of the camshaft 38 is selected in such a way that, during travel from the position $S_a$ to the position $S_e$, the carriage 24 moves in synchronism with the removing conveyor 3, at least during a certain portion of its travel from the position $S_a$ to the position $S_e$. During such movement of the carriage 24 in synchronism with the removing conveyor 3 (see the curve B of FIG. 3), the tongs 22 opens and the layer 21 which was theretofore held by the tongs is accepted and engaged by the removing conveyor 3 which transports the layer to the stacking station 200 of FIG. 4. The tongs 22 is already open when the camshaft 38 reaches the angular position $\phi_1$ and, at such time, the layer 21 which was previously held by the jaws 27 and 31, is already engaged by the neighboring reaches of the endless belts 18, 19 forming part of the removing conveyor 3. Such position of the transfer unit 2 is shown in FIG. 1.

Figure 5:
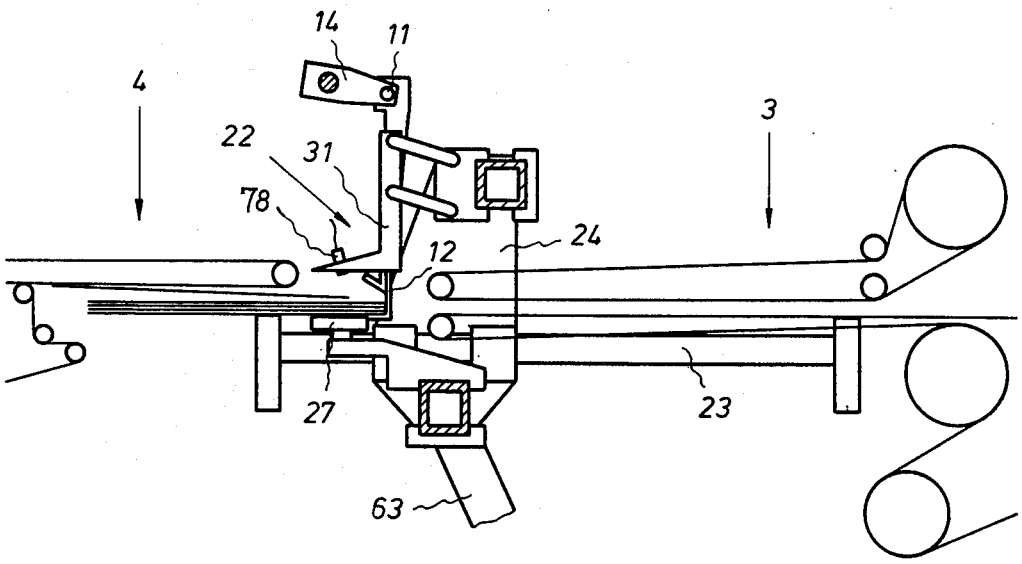
FIG. 5 illustrates a portion of the structure which is shown in FIG. 1 with the moving parts which are controlled by cams on the timing shaft in certain first positions.

The camshaft 38 continues to rotate from the angular position $\phi_1$ to the angular position $\phi_2$; this entails a movement of the carriage 24 back to its foremost position $S_a$ and the stop 9 descends as indicated by the curve C shown in FIG. 3. This means that the groups 8 which were accumulated at the gathering station 1 during removal of the previously assembled layer 21 are deposited onto the lower jaw 27 of the tongs 22. The accumulation of previously delivered groups 8 took place on the pallets 13 of the levers 12 which together constitute the stop 9. The positions of component parts of the transfer unit 2 and its carriage 24 in the angular position $\phi_2$ of the camshaft 38 are shown in FIG. 5. As indicated by the curve D of FIG. 3, the stop 9 is located in its foremost position and is held in the lower end position (see the curve C of FIG. 3), the tongs 22 is open and the carriage 24 dwells in its foremost position $S_a$.

Figure 6:
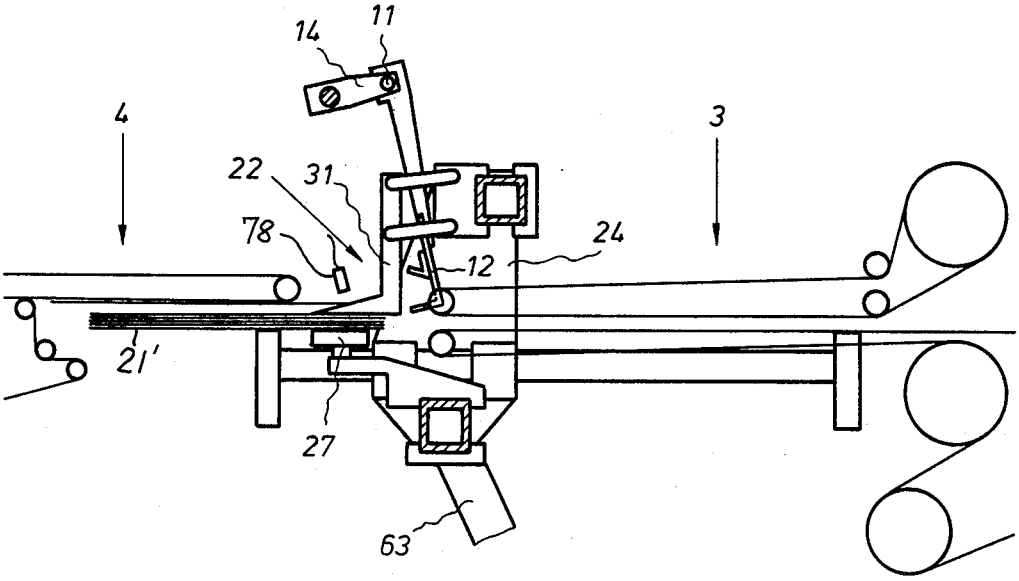
FIG. 6 shows the structure of FIG. 5 but with the moving parts in different second positions.

The camshaft 38 continues to rotate toward the angular position $\phi_3$ while the carriage 24 dwells in the foremost position $S_a$. The tongs 22 closes and thereby engages the next layer 21'. The stop 9 dwells in its lowermost position. When the camshaft 38 reaches the angular position $\phi_4$, the stop 9 is pivoted backwardly and thereby releases the layer 21' which was supported by the pallets 13 of the levers 12. The camshaft 38 continues to rotate from the angular position $\phi_4$ to the angular position $\phi_5$ whereby the stop 9 moves upwardly so that it releases the theretofore held layer and opens the path for removal of such layer in a direction toward the conveyor 3. Such position of the stop 9 is illustrated in FIG. 6. The stop 9 is thereupon pivoted back to its front end position so that all parts reassume their original or starting positions when the camshaft 38 completes an angular movement of 360°, namely, when it assumes the angular position indicated at 0° or 360° in FIG. 3.

The gathering of groups 8 into layers 21 in the aforedescribed manner entails that a layer constitutes the smallest unit of a fully assembled stack. It follows that, when the motor 71 drives the camshaft 38 at a constant speed, the total number n of sheets in a stack at the station 200 must equal a whole multiple of the number r x z of sheets in a layer wherein r is the number of sheets in a group 8 and z is the number of groups 8 in a layer. This would considerably limit the versatility of the apparatus by limiting the number of sheets which can be selected for accumulation into stacks.

In accordance with the invention, the number of sheets in a stack can be selected practically at will by varying the number of machine cycles per working cycle, namely, by changing the number of groups 8 which are formed during one full revolution of the camshaft 38. Otherwise stated, the invention provides a possibility of changing the number of groups in successively assembled layers 21, 21', etc. so that, by properly selecting the number of layers which together form a stack and by properly selecting the number of groups which form a layer, the finished stacks can consist of practically any desired numbers of sheets. The ratio of machine cycles to working cycles can be said to constitute the machine cycle-working cycle-coincidence. The only limitation which still exists is that the total number (n) of sheets in a stack must be divisible by the number r which is the number of sheets in a group 8.

In order to be in a position to achieve variable machine cycle-working cycle coincidences, it is necessary to change the speed of the camshaft 38 between a first speed (basic speed) $v_1$ and at least one second speed (correction speed) $v_2$ in the course of assembly of a given stack. The speed $v_1$ of the camshaft 38 is such that it is a whole multiple of a first number ($z_1$) of machine cycles so that, while the camshaft 38 rotates at the velocity $v_1$, it enables the gathering station 1 to accumulate a certain number of groups 8 to form a layer with $z_1$ groups. Such layer is thereupon transferred into the range of the removing conveyor 3 and on to the stacking station 200. If the speed of the camshaft 38 is thereupon changed to $v_2$, the cross cutter 76 can complete a different number of cuts across r webs 77 so that it forms a total number of $z_2$ groups 8, i.e., a number which is different from the number $z_1$.

The speed of removal of successively assembled layers 21 from the station 1 is varied simultaneously with adjustments of the stop 9, i.e., with changes of angular velocity of the camshaft 38. The circuit of FIG. 4 ensures that the speed of motor 71 is changed in response to changes of the speed of the motor 82 and/or 101 as well as that the speed of the motor 71 can be changed independently of the motors 82 and 101 (i.e., to change from the speed $v_1$ to the speed $v_2$ or vice versa).

Thus, one can alternately assemble layers 21, 21', etc. which contain larger and smaller numbers of groups 8. Otherwise stated, preliminary gathering of stacks at the station 1 can take place in accordance with a preselected pattern which can be said to constitute a ($z_1$:1)-machine cycle-working-cycle coincidence or a ($z_2$:1)-machine cycle-working-cycle coincidence. The changing pattern is attributable to the ability of the circuit shown in FIG. 4 to change the speed of the motor 71 for the camshaft 38 in such a way that the speed of the camshaft 38 can equal $v_1$ or $v_2$ which means that a stack which contains n sheets wherein n is not a whole multiple of r times z (wherein r is the number of sheets in a group 8 and z is the number of groups 8 in a layer) can be assembled in accordance with a pattern which may be expressed by the equation ($z_1$ times r) times p+($z_2$ times r) times q=n wherein p is the number of working cycles which are performed while the camshaft 38 is driven at the speed $v_1$ and q is the number of working cycles which are performed while the camshaft 38 is rotated at the speed $v_2$. In the above equation, $z_1$ is the number of groups 8 which are formed per working cycle while the camshaft 38 rotates at the speed $v_1$, and $z_2$ is the number of groups 8 which are formed per working cycle while the camshaft 38 is driven at the speed $v_2$. In each instance, n divided by r is a whole number.

The following example will facilitate the understanding of the meaning of variable machine-cycle-working-cycle coincidences:

It is assumed that a stack which is to be accumulated at the station 200 should contain a total of n=498 sheets. It is further assumed that the cross cutter 76 forms groups 8 of six sheets each, i.e., r=6 wherein r not only denotes the number of sheets per group 8 but also the number of reels 100 (or that number of reels 100 which are in actual use, i.e., from which webs 77 are being drawn to the subdividing or severing station accommodating the cross cutter 76). If the speed of the motor 71 for the camshaft 38 were constant, the apparatus would be unable to accumulate a stack of 498 sheets except if each and every layer 21 would contain a single group 8, i.e., if the stack at the station 200 were to be assembled of 83 layers each consisting of six paper sheets. This would be a cumbersome procedure which would take up a considerable amount of time. Furthermore, and if the motor 71 were to be driven at a single speed, the apparatus would be incapable of assembling stacks of 498 sheets each if the duration of each working cycle would equal the combined duration of a certain number (e.g., z=5) of machine cycles. This will be readily appreciated since, if z=5 and r=6, each layer 21 contains 30 sheets and the stack at the station can contain 480 or 510 sheets but not 498 sheets because 498 is not a whole multiple of 30.

As explained above, the circuit of FIG. 4 renders it possible to vary the number of groups 8 in a layer by the simple expedient of changing the speed (v) of the motor 71 from $v_1$ to $v_2$ or vice versa. This enables the apparatus to accumulate stacks wherein the number of sheets can be selected practically at will with the sole exception that the total number (n) of sheets in a stack must be a whole multiple of the number (r) of sheets in a group 8. Otherwise stated, the number (z) of groups 8 in a layer 21 can be changed from $z_1$ to $z_2$ and vice versa. This can be accomplished as follows:

The selector circuit 92 may constitute a simple or relatively simple computer which can be programmed in the aforedescribed manner, i.e., by furnishing thereto information including the desired total number (n) of sheets in a stack (it is assumed that n=498), the number (r) of sheets per group 8 (it is assumed that r=6), and the desired number ($z_1$) of groups 8 in a layer 21 while the motor 71 drives the camshaft 38 at the speed $v_1$ (i.e., at the basic speed). It is assumed that the selected number $z_1$ equals 5. This means that, as long as the motor 71 drives the camshaft 38 at the speed $v_1$, the station 1 gathers a series of successive layers 21 each of which contains 30 sheets (five groups 8 of six sheets each). The computer (selector circuit 92) is preferably programmed in such a way that the second or alternate machine cycle-working-cycle coincidence is selected in accordance with the equation $z_{2=z1}+1$, i.e., that $z_2$ equals 6. This means that, when the motor 71 drives the camshaft 38 at the speed $z_2$, each layer at the station 1 will contain 36 sheets because r=6 and $z_2$=6.

As explained above, the circuit 86 determines the speed of the motor 82 (i.e., the machine cycle) in dependency on the speed of webs 77, and the circuit 87 determines the length of sheets (the format) which are formed by the cross cutter 76 as a result of repeated severing of six overlapping webs 77. The quotient (see the dividing circuit 88) of signals which are furnished by the circuits 86 and 87 is the reference signal for the comparator circuit 94 which generates control signals for the control circuit 83 which regulates the speed of the motor 82 for the cross cutter 76. Thus, by changing the speed of the motor 82 while the speed at which the webs 77 are transported to the severing station remains unchanged, one can form groups 8 with longer or shorter sheets.

On receipt of information as to n, r and $z_1$, the computer 92 calculates the values of p and q in accordance with the aforementioned equation ($z_1$ times r) times p+($z_2$ times r) times q=n because $z_2$ is known on the basis of the equation $z_2=z_1+1$. The corresponding signals are transmitted to the dividing circuit 93 which transmits an output signal representing the quotient of the signals at the outputs of the computer 92 and dividing circuit 88. The quotient denoting signal at the output of the circuit 93 is a reference signal for the comparator circuit 97 which generates control signals for the control circuit 91 which regulates the speed of the camshaft 38 accordingly. The speed $v_2$ of the camshaft 38 is lower than the speed $v_1$ because, while the camshaft 38 is driven at the speed $v_1$, the cross cutter 76 is capable of forming only five groups 8 during each revolution of the camshaft 38 but the cross cutter 76 can make six groups 8 during each revolution of the camshaft 38 when the speed of the camshaft equals $v_2$.

In the aforementioned example, the computer 92 will select p=13 and q=3. Thus, the control circuit 71 causes the camshaft 38 to perform 13 revolutions at the speed $v_1$ so that the cross cutter 76 can form five groups 8 during each revolution of the camshaft, and the control circuit 71 thereupon causes the camshaft 38 to perform three revolutions at the speed $v_2$ so that the cross cutter 76 has time to make six groups 8 during each revolution of the camshaft. After the first thirteen revolutions of the camshaft 38, the growing stack at the station 200 contains a total of 390 superimposed sheets (namely p times r times $z_1$). The next three revolutions of the camshaft 38 entail the transfer of three additional layers each of which contains q times r times $z_2=108$ sheets so that the station 200 accumulates a stack with 498 sheets. Thus, the ratio of machine cycles to working cycles rises from five-to-one (the first 13 working cycles) to six-to-one (the next three working cycles). The fully assembled stack (with 498 sheets) is thereupon removed from the station 200 in a manner not forming part of the invention or is identified by a marker strip or in another suitable way so as to indicate the boundary between neighboring stacks if two or more stacks are to be assembled at the station 200 prior to transfer to the next processing station, e.g., to a packing machine.

The detectors 78 and 74 transmit signals at rates respectively corresponding to the frequencies of the machine cycles and working cycles. Thus, the detector 78 transmits a signal in response to each revolution of a knife holder 76*b*, and the detector 74 transmits a signal in response to each revolution of the camshaft 38. Such signals are transmitted to the correcting circuit 79 which influences the control circuit 91 for the motor 71, especially during and after transition from a first speed ($v_1$) to a different second speed ($v_2$) of the camshaft 38 or vice versa.

The above example (accumulation of a stack with 498 sheets) is illustrative of but one of a very large number of different modes of operation of the improved apparatus. Thus, the apparatus can accumulate larger or smaller stacks by the simple expedient of selecting a given interval of rotation of the camshaft 38 at the speed $v_1$ and a given interval of rotation at the speed $v_2$. The sole limitation (or the sole clear-cut limitation) is that the number n (total number of sheets in a stack) must be a whole multiple of the number (r) of sheets in a group 8. However, even this limitation can be avoided or compensated for by accumulating a short or a long series of successive stacks in such a way that the average number of sheets per stack equals a number N (e.g., 500 sheets) which is not a whole multiple of the number r. This will be readily understood with reference to the following example:

If N=500, if r=6, if $z_1=5$, and if $z_2=6$, one can accumulate two successive stacks of 498 sheets each in the previously described manner (namely, by assembling each such stack with resort to p=13 first working cycles and q=3 second working cycles), and by thereupon assembling a stack with 504 sheets with resort to p=12 first working cycles and q=4 second working cycles. The average number (N) of sheets in the three successively formed stacks is then 500.

The computer 92 can readily take into consideration one or more additional parameters which can or should influence the duration of working cycles of the apparatus. For example, the computer 92 can be programmed to take into account the maximum or minimum permissible (limit) speed or speeds of one or more aggregates or units in the improved apparatus or in the machine which embodies the apparatus. One such parameter is the maximum permissible speed of the cross cutter 76. This is taken into consideration by appropriate selection of the number ($z_1$) of groups 8 which are assembled into a layer while the camshaft 38 is driven at the speed $v_1$. FIG. 4 shows that such information can be furnished to the computer 92 at the input i. An advantage of programming the computer 92 by full consideration of the maximum permissible speed of the cross cutter 76 (and/or the maximum or minimum permissible speed of one or more additional aggregates) is that one reduces the likelihood of malfunction which would be more pronounced if the speed of one or more aggregates would exceed or would be less than an acceptable or permissible maximum or minimum value. For example, the operation of cross cutter 76 at an excessive speed could entail the making of unclean cuts or undesirable changes of orientation of sheets in successive groups 8 and/or undesirable changes of orientation of successive groups.

The transition from rotation of the camshaft 38 at the speed $v_1$ to rotation of this camshaft at the speed $v_2$ should take place very rapidly because the cross cutter 76 continues to form groups 8 at a normally unchanging rate. Therefore, the circuit of FIG. 4 is designed to ensure practically instantaneous changeover from the speed $v_1$ to the speed $v_2$ of the camshaft 38 under the influence of the computer 92 which ensures that the circuits 93 and 91 effect, without any delay, a changeover from the formation of layers with $z_1$ groups to the formation of layers with $z_2$ groups or vice versa. Uninterrupted rotation of the camshaft 38 also contributes to practically instantaneous transition from the speed $v_1$ to the speed $v_2$ or vice versa. The transition from the speed $v_1$ to the speed $v_2$ or vice versa is fully automatic because, once the computer 92 has been properly programmed on receipt of information pertaining to the desired number (n) of sheets in a stack, to the number (r) of sheets in a group 8, and to the number ($z_1$) of groups 8 in a layer when the motor 71 drives the camshaft 38 at the first speed $v_1$, the computer can properly control the circuit 91 and hence the motor 71 for the camshaft 38 so that the attendants need not monitor the timing of and/or initiate a changeover from the speed $v_1$ to the speed $v_2$ or vice versa.

It is clear that the apparatus could be designed to assemble stacks from three or more different layers, e.g., from one or more ($x_1$) layers having p groups 8, one or more ($x_2$) layers having q groups 8 and/or one or more ($x_3$) layers having s groups 8. This would merely amount to a multiplication of the aforedescribed procedure of assembling stacks from first layers having $z_1$ groups 8 and second layers having $z_2$ groups 8. It has been found that, at least in the majority of paper processing machines, the aforedescribed procedure (forming layers with $x_1$ and $x_2$ groups 8) normally suffices to form stacks with practically any desired numbers of sheets (either per layer or on the average in two or more successively assembled layers).

The improved apparatus exhibits a number of important advantages. Thus, by resorting to the accumulation or gathering of groups 8 into layers 21, 21', etc. which, in turn, are converted or assembled into successive stacks, one can provide reasonably long intervals of time for removal of fully assembled stacks from the station 200. This will be readily appreciated since, if the groups 8 were transported directly to the station 200, the latter would receive a group during each machine cycle instead of during each working cycle. In other words, the interval for removal of a fully assembled stack would be reduced to a fraction of the interval which is available by resorting to the improved apparatus (the fraction would equal $1:z_1$ or $1:z_2$ of the interval which is available when the duration of a working cycle is a multiple of the duration of a machine cycle. By prolonging the interval which is available for removal of a fully assembled stack, the apparatus can increase the rate of making and stacking sheets because, in most instances, the length of the interval for removal of a fully assembled stack is the cause that the apparatus cannot turn out a larger number of stacks per unit of time.

Another important advantage of the improved apparatus is that it can assemble stacks with practically any desired numbers of sheets therein. As explained above, the only limitation is that the number (n) of sheets in a fully assembled stack must be a whole multiple of the number (r) of sheets in a group. However, the number of sheets in a fully grown stack need not be a whole multiple of the number of sheets in a layer because the number of sheets in the layers can be varied by changing the number of machine cycles per working cycle, i.e., the number of groups in a layer. Such change is accomplished with the circuit of FIG. 4 or with an analogous circuit while the camshaft 38 rotates continuously. This allows for rapid changeover from a first to a different second speed of the camshaft or vice versa.

The versatility of the improved apparatus is incomparably higher than that of heretofore known apparatus which cannot accumulate layers with different numbers of sheets except by completely redesigning the apparatus. In accordance with the present invention, a changeover from one machine cycle-working cycle ratio to a different ratio can be effected while the apparatus is in use, i.e., it is not even necessary to arrest the motor 71 and/or 82.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for forming stacks of paper sheets or the like, comprising a first station and a second station; means for supplying to said first station a series of groups of sheets; gathering means for accumulating successively supplied groups at said first station into a succession of layers; means for transporting successive layers from said first station to said second station for accumulation into stacks at said second station, said transporting means including an adjustable transfer unit arranged to withdraw successive layers from said first station and means for imparting motion to said transfer unit; and means for varying the frequency of removal of layers from said first station by said transfer unit so that at least some successively accumulated layers contain different number of groups, including prime mover means for continuously driving said motion imparting means and means for varying the speed of said prime mover means.

2. The apparatus of claim 1, further comprising means for forming said groups including a plurality of sources of coherent sheets and means for simultaneously severing such coherent sheets at a preselected frequency so that each severing operation results in the making of a group of discrete sheets whose number equals the number of said sources.

3. The apparatus of claim 2, wherein said transporting means further comprises a conveyor arranged to convey layers of groups from said transfer unit to said second station.

4. The apparatus of claim 3, further comprising second prime mover means for said severing means, said gathering means including a mobile gathering device at said first station and said first mentioned prime mover means being arranged to drive said gathering device.

5. The apparatus of claim 4, further comprising means for connecting said first mentioned prime mover means with said transfer unit.

6. The apparatus of claim 5, wherein said first mentioned prime mover means comprises a variable-speed electric motor, said second prime mover means comprising a second variable-speed motor whose speed is variable independently of said electric motor.

7. The apparatus of claim 6, further comprising variable-speed third prime mover means for advancing coherent sheets from said sources to said severing means, and means for adjusting the speed of said third prime mover means independently of said electric motor.

8. The apparatus of claim 6, wherein said adjusting means further comprises first and second signal generating detector means for respectively monitoring the speeds of said first mentioned and second prime mover means and control means for changing the speeds of said prime mover means when the characteristics of signals generated by the respective detector means deviate from predetermined values.

9. The apparatus of claim 8, wherein said adjusting means further comprises selector means for transmitting to the control means for said first mentioned prime mover means reference signals denoting the desired speed of said first mentioned prime mover means.

10. The apparatus of claim 9, wherein said selector means includes a computer.

11. The apparatus of claim 9, further comprising means for recording the number of groups in successively accumulated layers.

12. The apparatus of claim 11, wherein said selector means comprises computer means having signal transmitting output means connected with said recording means.

13. The apparatus of claim 11, wherein said recording means comprises means for visually indicating the numbers of groups in successive layers.

14. The apparatus of claim 11, wherein said recording means includes means for producing a permanent record of the numbers of groups in successive layers.

15. The apparatus of claim 5, further comprising a timing device interposed between said first mentioned prime mover means on the one hand and said gathering device and said connecting means on the other hand.

16. The apparatus of claim 15, wherein said timing device comprises a rotary shaft and said first mentioned prime mover means is arranged to continuously drive said shaft at a speed which is determined by said speed varying means.

17. The apparatus of claim 16, wherein said shaft is a camshaft.

18. Apparatus for forming stacks of paper sheets or the like, comprising means for forming a succession of groups of overlapping sheets each containing a predetermined number of sheets, including means for superimposing several coherent sheets and means for repeatedly severing such superimposed coherent sheets to separate successive foremost sheets therefrom whereby the separated foremost sheets together constitute a group; means for accumulating at least one first layer from a first number of successively formed groups and thereupon at least one second layer from a second number of successively accumulated groups at a first station; adjustable means for transferring the first and second layers from the first station to a second station, including a transfer unit movable from and returnable to said first station; means for stacking the first and second layers at the second station; and means for operating said transfer means and said accumulating means, including motion imparting means, variable-speed prime mover means for continuously driving said motion imparting means, and means for varying the speed of said prime mover means to thereby vary the frequency at which said transfer unit returns to said first station.

* * * * *

UNITED STATES PATENT AND TRADEMARK OFFICE

CERTIFICATE OF CORRECTION

PATENT NO. : 4,474,093

DATED : October 2, 1984

INVENTOR(S) : Siegmar NEUBÜSER et al.

It is certified that error appears in the above-identified patent and that said Letters Patent are hereby corrected as shown below:

Foremost page [62] change "287,190" to --287,170--.

Signed and Sealed this

*Fourteenth* Day of *May 1985*

[SEAL]

*Attest:*

DONALD J. QUIGG

*Attesting Officer* *Acting Commissioner of Patents and Trademarks*